US006126798A

United States Patent [19]

Reid et al.

[11] Patent Number: 6,126,798

[45] **Date of Patent: *Oct. 3, 2000**

[54] ELECTROPLATING ANODE INCLUDING MEMBRANE PARTITION SYSTEM AND METHOD OF PREVENTING PASSIVATION OF SAME

[75] Inventors: Jonathan David Reid, Sherwood; Robert J. Contolini, Lake Oswego, both of Oreg.; John Owen Dukovic, Pleasantville, N.Y.

[73] Assignees: Novellus Systems, Inc., San Jose, Calif.; International Business Machines Corp., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/969,196

[22] Filed: Nov. 13, 1997

[51] Int. Cl.[7] ..... C25B 13/00

[52] U.S. Cl. ..... 204/282; 204/283; 204/297 R; 204/297 W

[58] Field of Search ..... 204/282, 283, 204/297 R, 297 W; 118/232

[56] References Cited

U.S. PATENT DOCUMENTS

| | | | |
|---|---|---|---|
| 3,962,047 | 6/1976 | Wagner | 204/15 |
| 4,137,867 | 2/1979 | Aigo | 118/627 |
| 4,170,959 | 10/1979 | Aigo | 118/627 |
| 4,246,088 | 1/1981 | Murphy et al. | 204/181 R |
| 4,259,166 | 3/1981 | Whitehurst | 204/279 |
| 4,280,882 | 7/1981 | Hovey | 204/15 |
| 4,304,641 | 12/1981 | Grandia et al. | 204/23 |
| 4,339,297 | 7/1982 | Aigo | 156/345 |
| 4,341,613 | 7/1982 | Aigo | 204/224 |
| 4,466,864 | 8/1984 | Bacon et al. | 204/15 |
| 4,469,566 | 9/1984 | Wray | 204/23 |
| 4,534,832 | 8/1985 | Doiron | 204/15 |
| 4,565,607 | 1/1986 | Hanak et al. | 204/38.1 |
| 4,597,836 | 7/1986 | Schaer et al. | 204/4 |
| 4,696,729 | 9/1987 | Santini | 204/224 R |
| 4,828,654 | 5/1989 | Reed | 204/23 |
| 4,861,452 | 8/1989 | Stierman et al. | 204/297 |
| 4,879,007 | 11/1989 | Wong | 204/15 |

(List continued on next page.)

OTHER PUBLICATIONS

"Upside–Down Resist Coating of Seminconductor Wafers", IBM Technical Disclosure Bulletin, vol. 32, No. 1, Jun. 1989, pp. 311–313.

Evan E. Patton, et al. "Automated Gold Plate–Up Bath Scope Document and Machine Specifications", Tektronix Confidential, dated Aug. 4, 1989, pp. 1–13.

Tektronix Invention Disclosure Form (Company Confidential), not dated, 4 pages

*Primary Examiner*—Bruce F. Bell

*Attorney, Agent, or Firm*—Skjerven, Morrill, MacPherson, Franklin & Friel LLP; David E. Steuber

[57] ABSTRACT

An anode includes an anode cup, a membrane and ion source material, the anode cup and membrane forming an enclosure in which the ion source material is located. The anode cup includes a base section having a central aperture and the membrane also has a central aperture. A jet is passed through the central apertures of the base section of the anode cup and through the membrane allowing plating solution to be directed at the center of a wafer being electroplated.

38 Claims, 4 Drawing Sheets

U.S. PATENT DOCUMENTS

| | | | |
|---|---|---|---|
| 4,906,346 | 3/1990 | Hadersbeck et al. | 204/238 |
| 4,931,149 | 6/1990 | Stierman et al. | 204/15 |
| 5,000,827 | 3/1991 | Schuster et al. | 204/15 |
| 5,024,746 | 6/1991 | Stierman et al. | 204/297 W |
| 5,078,852 | 1/1992 | Yee et al. | 204/297 R |
| 5,096,550 | 3/1992 | Mayer et al. | 204/129.1 |
| 5,135,636 | 8/1992 | Yee et al. | 205/96 |
| 5,222,310 | 6/1993 | Thompson et al. | 34/202 |
| 5,227,041 | 7/1993 | Brogden et al. | 204/297 R |
| 5,332,487 | 7/1994 | Young et al. | 205/80 |
| 5,372,699 | 12/1994 | Rischke et al. | 205/129 |
| 5,377,708 | 1/1995 | Bergman et al. | 134/105 |
| 5,391,285 | 2/1995 | Lytle et al. | 205/123 |
| 5,405,518 | 4/1995 | Hsich et al. | 204/297 |
| 5,421,987 | 6/1995 | Tzanavaras et al. | 205/133 |
| 5,429,733 | 7/1995 | Ishida | 204/224 R |
| 5,437,777 | 8/1995 | Kishi | 204/224 R |
| 5,441,629 | 8/1995 | Kosaki | 204/277 |
| 5,443,707 | 8/1995 | Mori | 204/242 |
| 5,447,615 | 9/1995 | Ishida | 204/224 R |
| 5,462,649 | 10/1995 | Keeney et al. | 205/93 |
| 5,472,592 | 12/1995 | Lowery | 205/137 |
| 5,498,325 | 3/1996 | Nishimura et al. | 205/96 |
| 5,522,975 | 6/1996 | Andricacos et al. | 204/297 R |
| 5,597,460 | 1/1997 | Reynolds | 204/283 |
| 5,670,034 | 9/1997 | Lowery | 205/143 |
| 5,725,745 | 3/1998 | Ikegaya | 204/297 R |
| 5,750,014 | 5/1998 | Stadler et al. | 204/224 |
| 5,776,327 | 7/1998 | Botts et al. | 205/96 |
| 5,788,829 | 8/1998 | Joshi et al. | 205/96 |
| 5,804,052 | 9/1998 | Schneider | 205/96 |
| 5,843,296 | 12/1998 | Greenspan | 205/68 |
| 5,855,850 | 1/1999 | Sittler | 422/98 |

ELECTROPLATING ANODE INCLUDING MEMBRANE PARTITION SYSTEM AND METHOD OF PREVENTING PASSIVATION OF SAME

CROSS REFERENCE TO RELATED APPLICATION

This application is related to Patton et al., co-filed application Ser. No. 08/969,984, filed Nov. 13, 1997, pending, Reid et al., co-filed application Ser. No. 08/969,267, filed Nov. 13, 1997, pending and Contolini et al., co-filed application Ser. No. 08/970,120, filed Nov. 13, 1997, pending, all of which are incorporated herein by reference in their entirety.

FIELD OF INVENTION

The present invention relates generally to electroplating and more particularly an anode for an electroplating system.

BACKGROUND OF THE INVENTION

The manufacture of semiconductor devices often requires the formation of electrical conductors on semiconductor wafers. For example, electrically conductive leads on the wafer are often formed by electroplating (depositing) an electrically conductive material such as copper on the wafer and into patterned trenches.

Electroplating involves making electrical contact with the wafer surface upon which the electrically conductive layer is to be deposited (hereinafter the "wafer plating surface"). Current is then passed through a plating solution (i.e. a solution containing ions of the element being deposited, for example a solution containing $Cu^{++}$) between an anode and the wafer plating surface (the wafer plating surface being the cathode). This causes an electrochemical reaction on the wafer plating surface which results in the deposition of the electrically conductive layer.

Generally, electroplating systems use soluble or insoluble anodes. Insoluble anodes tend to evolve oxygen bubbles which adhere to the wafer plating surface. These oxygen bubbles disrupt the flow of ions and electrical current to the wafer plating surface creating nonuniformity in the deposited electrically conductive layer. For this reason, soluble anodes are frequently used.

Soluble anodes are not without disadvantages. One disadvantage is that soluble anodes, by definition, dissolve. As a soluble anode dissolves, it releases particulates into the plating solution. These particulates can contaminate the wafer plating surface, reducing the reliability and yield of the semiconductor devices formed on the wafer.

One conventional technique of reducing particulate contamination is to contain the soluble anode in a porous anode bag. However, while preventing large size particulates and chunks from being released into the plating solution, conventional anode bags fail to prevent smaller sized particulates from entering the plating solution and contaminating the wafer plating surface.

Another conventional technique of reducing particulate contamination is to place a filter between the anode and the article to be electroplated as set forth in Reed, U.S. Pat. No. 4,828,654 (hereinafter Reed). Referring to FIG. 2 of Reed, filters 60 are positioned between anode arrays 20 and a printed circuit board 50 (PCB 50). Filters 60 allows only ionic material of a relatively small size, for example one micron, to pass from anode arrays 20 to PCB 50. While allowing relatively small size particulates to pass through, filters 60 trap larger sized particulates avoiding contamination of PCB 50 from these larger sized particulates. Over time, however, filters 60 become clogged by these larger sized particulates.

To reduce clogging of filters 60, Reed provides a counterflow of plating solution through filters 60 in a direction from PCB 50 towards anode arrays 20. This counterflow tends to wash some of the larger sized particulates from filters 60. However, even with the counterflow, eventually filters 60 become clogged. To allow servicing of filters 60, retaining strips 66 and support strips 68 allow filters 60 to be removed and cleaned when filters 60 eventually become clogged.

Although providing a convenient means of cleaning filters 60, removal of filters 60 necessarily releases the larger sized particulates from within the vicinity of anode arrays 20 into the entire system and, in particular, into the vicinity where PCBs 50 are electroplated. Even after filters 60 are cleaned and replaced, this contamination of the system can cause contamination of a subsequently electroplated PCE 50 reducing the reliability and yield of the printed circuit boards. Further, even with filters 60, particulates accumulate on receptacle 14 in the vicinity of anode arrays 20 and the system must periodically be shut down and drained of plating solution to clean these particulates from receptacle 14.

In addition to creating particulates, a soluble anode changes shape as it dissolves, resulting in variations in the electric field between the soluble anode and the wafer. Of importance, the thickness of the electrically conductive layer deposited on the wafer plating surface depends upon the electric field. Thus, variations in the shape of the soluble anode result in variations in the thickness of the deposited electrically conductive layer across the wafer plating surface. However, it is desirable that the electrically conductive layer be deposited uniformly (have a uniform thickness) across the wafer plating surface to minimize variations in characteristics of devices formed on the wafer.

Another disadvantage of soluble anodes is passivation. As is well known to those skilled in the art, the mechanism by which anode passivation occurs depends upon a variety of factors including the process conditions, plating solution and anode material. Generally, anode passivation inhibits dissolution of the anode while simultaneously preventing electrical current from being passed through the anode and should be avoided.

SUMMARY OF THE INVENTION

In accordance with the present invention an anode includes an anode cup, a membrane and ion source material. The anode source material is located in an enclosure formed by the anode cup and membrane. The anode cup and membrane both have central apertures through which a jet (a tube) is passed. During use, plating solution flows through the jet.

By passing the jet through the center of the anode, plating solution from the jet is directed at the center of the wafer being electroplated. This enhances removal of gas bubbles entrapped on the wafer plating surface and improves the uniformity of the deposited electrically conductive layer on the wafer.

The membrane has a porosity sufficient to allow ions from the ion source material, and hence electrical current, to flow through the membrane. Although allowing electrical current to pass, the membrane has a high electrical resistance which produces a voltage drop across the membrane during use.

This high electrical resistance redistributes localized high electrical currents over larger areas improving the uniformity of the electric current flux to the wafer which, in turn, improves the uniformity of the deposited electrically conductive layer on the wafer.

In addition to having a porosity sufficient to allow electrical current to pass, the membrane also has a porosity sufficient to allow plating solution to flow through the membrane. However, to prevent particulates generated by the ion source material from passing through the membrane and contaminating the wafer, the porosity of the membrane prevents contaminant particulates from passing through the membrane.

Of importance, when the membrane becomes clogged with particulates, the anode can be readily removed from the electroplating system. After removal of the anode, the membrane can be separated from the anode cup and cleaned or replaced. Advantageously, cleaning of the membrane is accomplished outside of the plating bath and, accordingly, without releasing particulates from inside of the anode into the plating bath.

In one embodiment, the jet includes a plating solution inlet through which plating solution flows from the jet into the enclosure formed by the anode cup and membrane and across the ion source material. The flow of plating solution across the ion source material prevents anode passivation. The plating solution then exits the enclosure via two routes. First, some of the plating solution exits through the membrane. As discussed above, contaminant particulates generated as the ion source material dissolves do not pass through the membrane and accordingly do not contaminate the wafer. Second, some of the plating solution exits through outlets located at the top of a wall section of the anode cup. These outlets are plumbed to an overflow receiver and thus the plating solution which flows through these outlets does not enter the plating bath and does not contaminate the wafer. Further, by locating these outlets at the top of the wall section of the anode cup, gas bubbles entrapped under the membrane are entrained with the exiting plating solution and readily removed from the anode.

These and other objects, features and advantages of the present invention will be more readily apparent from the detailed description of the preferred embodiments set forth below taken in conjunction with the accompanying drawings.

DETAILED DESCRIPTION OF THE PREFERRED EMBODIMENTS

Several elements in the following figures are substantially similar. Therefore similar reference numbers are used to represent similar elements.

Figure 1:
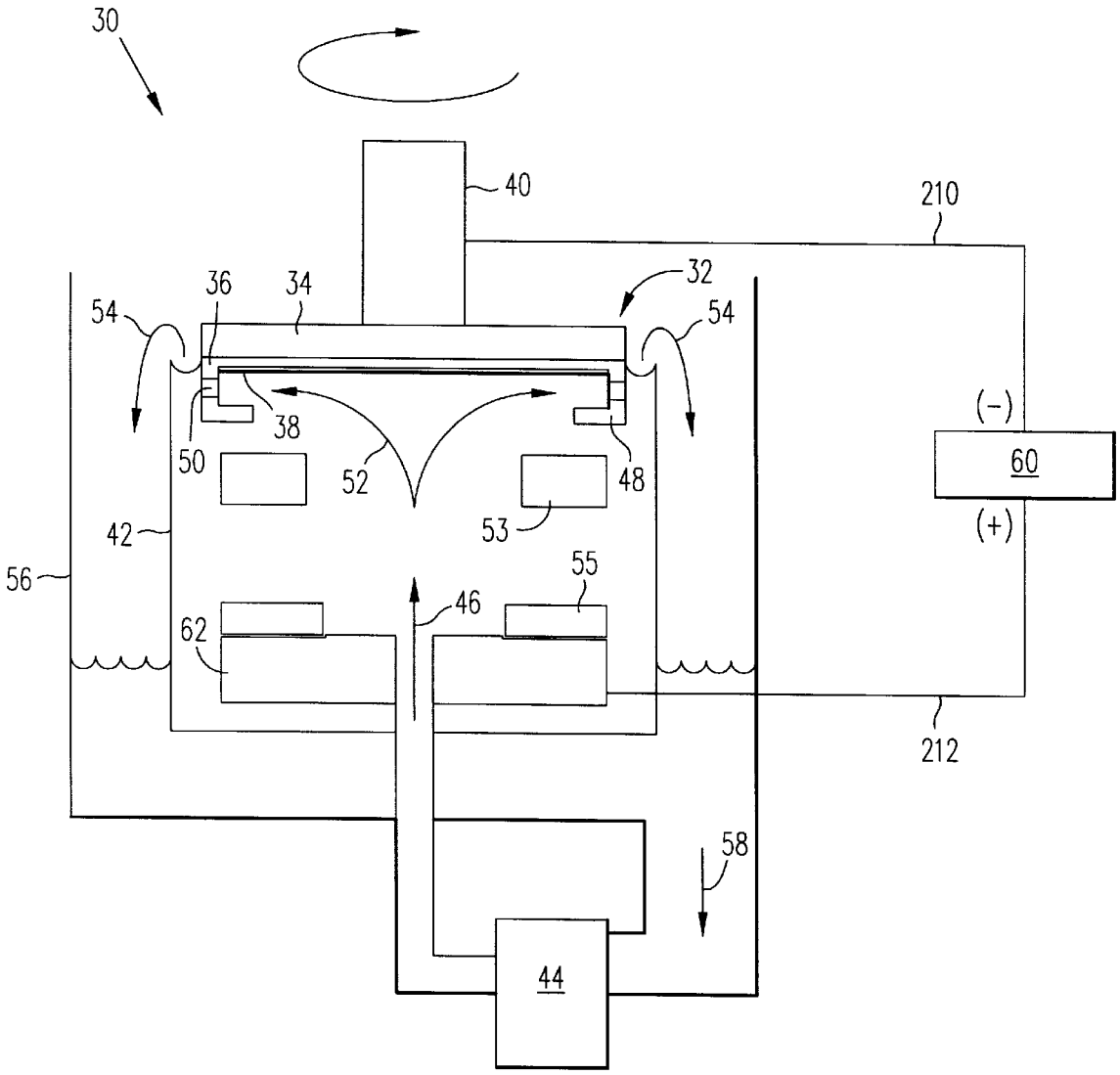
FIG. 1 is a diagrammatic view of an electroplating apparatus having a wafer mounted therein in accordance with the present invention.

FIG. 1 is a diagrammatic view of an electroplating apparatus 30 having a wafer 38 mounted therein in accordance with the present invention. Apparatus 30 includes a clamshell 32 mounted on a rotatable spindle 40 which allows rotation of clamshell 32. Clamshell 32 comprises a cone 34, a cup 36 and a flange 48. Flange 48 has formed therein a plurality of apertures 50. A clamshell lacking a flange 48 yet in other regards similar to clamshell 32 is described in detail in Patton et al., co-filed application Ser. No. 08/969,984, cited above. A clamshell including a flange similar to clamshell 32 is described in detail in Contolini et al., co-filed application Ser. No. 08/990,120, cited above.

During the electroplating process, wafer 38 is mounted in cup 36. Clamshell 32 and hence wafer 38 are then placed in a plating bath 42 containing a plating solution. As indicated by arrow 46, the plating solution is continually provided to plating bath 42 by a pump 44. Generally, the plating solution flows upwards to the center of wafer 38 and then radially outward and across wafer 38 through apertures 50 as indicated by arrows 52. Of importance, by directing the plating solution towards the center of wafer 38, any gas bubbles entrapped on wafer 38 are quickly removed through apertures 50. Gas bubble removal is further enhanced by rotating clamshell 32 and hence wafer 38.

The plating solution then overflows plating bath 42 to an overflow reservoir 56 as indicated by arrows 54. The plating solution is then filtered (not shown) and returned to pump 44 as indicated by arrow 58 completing the recirculation of the plating solution.

A DC power supply 60 has a negative output lead 210 electrically connected to wafer 38 through one or more slip rings, brushes and contacts (not shown). The positive output lead 212 of power supply 60 is electrically connected to an anode 62 located in plating bath 42. During use, power supply 60 biases wafer 38 to have a negative potential relative to anode 62 causing an electrical current to flow from anode 62 to wafer 38. (As used herein, electrical current flows in the same direction as the net positive ion flux and opposite the net electron flux.) This causes an electrochemical reaction (e.g. $Cu^{++}+2e^{-}=Cu$) on wafer 38 which results in the deposition of the electrically conductive layer (e.g. copper) on wafer 38. The ion concentration of the plating solution is replenished during the plating cycle by dissolving anode 62 which comprises, for example, a metallic compound (e.g. $Cu=Cu^{++}+2e^{-}$) as described in detail below. Shields 53 and 55 (virtual anodes) are provided to shape the electric field between anode 62 and wafer 38. The use and construction of shields are further described in Reid et al., co-filed application Ser. No. 08/969,267, cited above.

Figure 2:
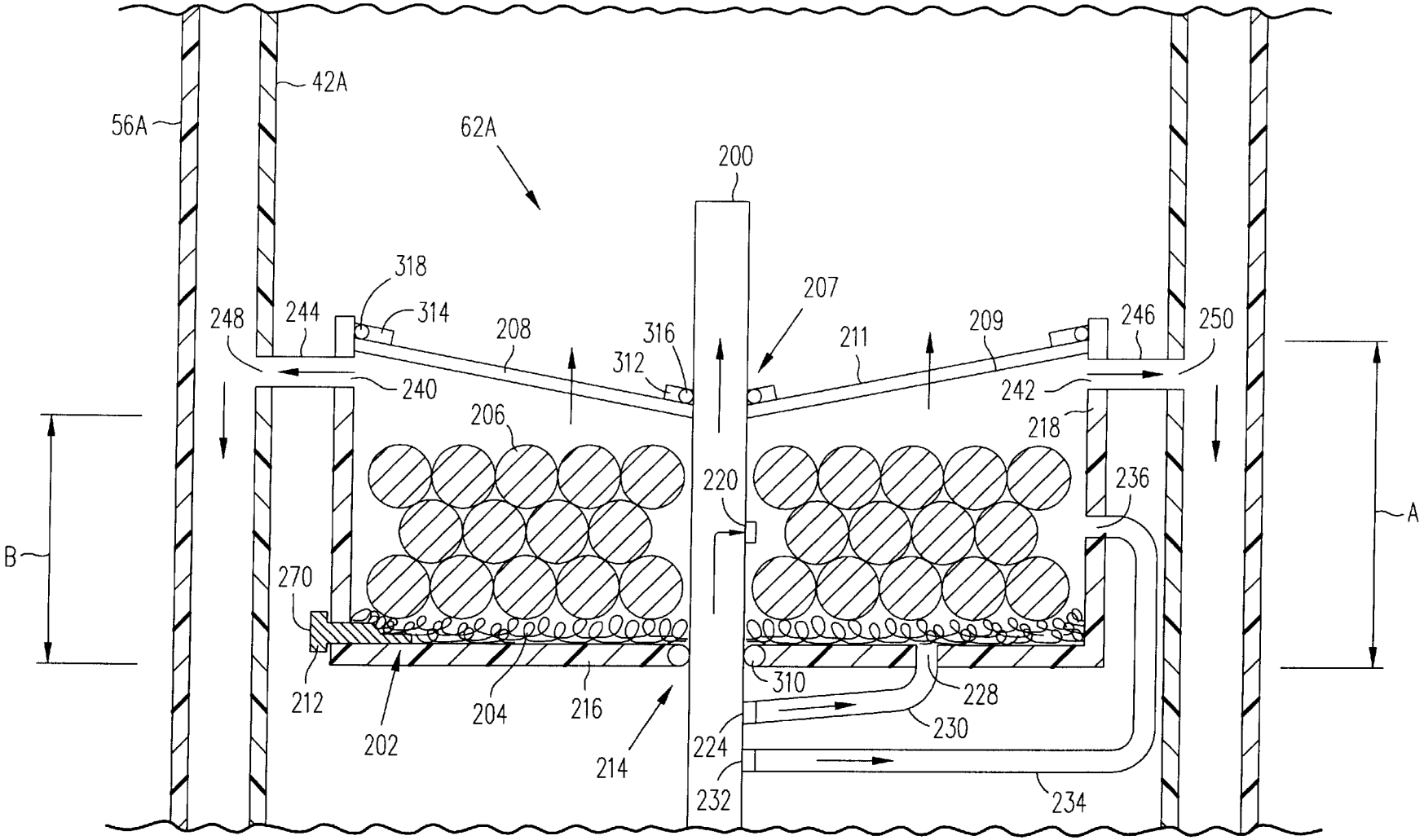
FIG. 2 is a cross-sectional view of an anode in accordance with the present invention.

As shown in FIG. 1, the plating solution is provided to plating bath 42 and directed at wafer 38 by a jet of plating solution indicated by arrow 46. Referring now to FIG. 2, a cross-sectional view of anode 62A having a jet 200 passing through the center is illustrated. Jet 200 typically consists of a tube formed of an electrically insulating material. Anode 62A comprises an anode cup 202, contact 204, ion source material 206, and a membrane 208.

Anode cup 202 is typically an electrically insulating material such as polyvinyl chloride (PVC), polypropylene or polyvinylidene flouride (PVDF). Anode cup 202 comprises a disk shaped base section 216 having a central aperture 214 through which jet 200 passes. An O-ring 310 forms the seal between jet 200 and base section 216 of anode cup 202. Anode cup 202 further comprises a cylindrical wall section 218 integrally attached at one end (the bottom) to base section 216.

Contact 204 is typically an electrically conductive relatively inert material such as titanium. Further, contact 204 can be fashioned in a variety of forms, e.g. can be a plate with raised perforations or, as illustrated in FIG. 2, a mesh.

Contact 204 rests on base section 216 of anode cup 202. Positive output lead 212 from power supply 60 (see FIG. 1) is formed of an electrically conductive relatively inert material such as titanium. Lead 212 is attached, typically bolted, to a rod 270 which is also formed of an electrically conductive relatively inert material such as titanium. Rod 270 passes through anode cup 202 to make the electrical connection with contact 204.

Resting on and electrically connected with contact 204 is ion source material 206, for example copper. Ion source material 206 comprises a plurality of granules. These granules can be fashioned in a variety of shapes such as in a spherical, nugget, flake or pelletized shape. In one embodiment, copper balls having a diameter in the range of 1.0 centimeters to 2.54 centimeters are used. Alternatively, ion source material 206 comprises an single integral piece such as a solid disk of material. During use, ion source material 206 electrochemically dissolves (e.g. $Cu=Cu^{2+}+2e^{-}$) replenishing the ion concentration of the plating solution.

Ion source material 206 is contained in an enclosure formed by anode cup 202, membrane 208 and jet 200. More particularly, membrane 208 is attached, typically welded, to a seal ring 312 at a central aperture 207 of membrane 208 and to a seal ring 314 at its outer circumference. Seal rings 312, 314 are formed of materials similar to those discussed above for anode cup 202. Seal ring 312 forms a seal with jet 200 by an O-ring 316 and seal ring 314 forms a seal with a second end (the top) of wall section 218 of anode cup 202 by an O-ring 318. By attaching membrane 208 to seal rings 312, 314, membrane 208 forms a seal at its outer circumference with the top of wall section 218 of anode cup 202 and also forms a seal with jet 200 at central aperture 207 of membrane 208. Suitable examples of membrane 208 include: napped polypropylene available from Anode Products, Inc. located in Illinois; spunbond snowpro polypropylene and various polyethylene, RYTON, and TEFLON materials in felt, monofilament, filament and spun forms available from various suppliers including Snow Filtration, 6386 Gano Rd., West Chester, Ohio.

In an alternative embodiment, membrane 208 is itself formed of a material having a sufficient rigidity to form a pressure fit with wall section 218 and jet 200 and seal rings 312, 314 are not provided.

Membrane 208 has a porosity sufficient to allow ions from ion source material 206, and hence electrical current, to flow through membrane 208. Although allowing electrical current to flow through, membrane 208 has a high electrical resistance which produces a voltage drop across membrane 208 from lower surface 209 to upper surface 211. This advantageously minimizes variations in the electric field from ion source material 206 as it dissolves and changes shape.

As an illustration, absent membrane 208, a region of ion source material 206 having a high electrical conductivity relative to the remainder of ion source material 206 would support a relatively high electrical current. This in turn would provide a relatively high electric current flux to the portion of the wafer directly above this region of ion source material 206, resulting in a greater thickness of the deposited electrically conductive layer on this portion of the wafer. However, by providing electrically resistive membrane 208, the relatively high electrical current from this region of ion source material 206 redistributes over a larger area to find the path of least resistance through membrane 208. Redistributing the relatively high electrical current over a larger area improves the uniformity of the electric current flux to the wafer which, in turn, improves the uniformity of the deposited electrically conductive layer.

In addition to having a porosity sufficient to allow electrical current to flow through, membrane 208 also has a porosity sufficient to allow plating solution to flow through membrane 208, i.e. has a porosity sufficient to allow liquid to pass through membrane 208. However, to prevent particulates generated by ion source material 206 from passing through membrane 208 and contaminating the wafer, the porosity of membrane 208 prevents large size particulates from passing through membrane 208. Generally, it is desirable to prevent particulates greater in size than one micron (1.0 $\mu$m) from passing through membrane 208 and in one embodiment particulates greater in size than 0.1 $\mu$m are prevented from passing through membrane 208.

Of importance, when membrane 208 becomes clogged with particulates such that electric current and plating solution flow through membrane 208 is unacceptably inhibited, anode 62A can readily be removed from plating bath 42A. After removal of anode 62A, membrane 208 is separated from anode cup 202 and cleaned or replaced. Advantageously, cleaning of membrane 208 is accomplished outside of plating bath 42A and, accordingly, without releasing particulates from inside of anode 62A into plating bath 42A. This is in contrast to Reed (cite above) wherein cleaning of the membrane necessarily releases particulates into the bulk of the plating solution. In further contrast to Reed, use of anode 62A including anode cup 202 and membrane 208 prevents particulate accumulation anywhere on plating bath 42A.

To prevent anode passivation, plating solution is directed into the enclosure formed by anode cup 202 and membrane 208 and across ion source material 206. As those skilled in the art understand, a flow of plating solution across an anode prevents anode passivation. The flow of plating solution into anode cup 202 is provided at several locations.

In this embodiment, jet 200 is fitted with a plating solution inlet 220 located between membrane 208 and base section 216. A portion of the plating solution flowing through jet 200 is diverted through inlet 220 and into anode cup 202. To prevent inadvertent backflow of plating solution and particulates from anode cup 202 into jet 200, inlet 220 is fitted with a check valve which allows the plating solution only to flow from jet 200 to anode cup 202 and not vice versa.

Jet 200 is also provided with a plating solution outlet 224 which is connected by a tube 230 to an inlet 228 on base section 216 of anode cup 202. In this manner, a portion of the plating solution from jet 200 is directed into the bottom of anode cup 202. Outlet 224 is fitted with a check valve to prevent backflow of plating solution and particulates from anode cup 202 into jet 200.

Jet 200 is also provided with an outlet 232 connected by a tube 234 to an inlet 236 on wall section 218 of anode cup 202. In this manner, a portion of the plating solution from jet 200 is directed into the side of anode cup 202. Outlet 232 is fitted with a check valve to prevent backflow of plating solution and particulates from anode cup 202 into jet 200.

Although inlets 228, 236 on anode cup 202 are connected to outlets 224, 232 on jet 200, respectively, in other embodiments (not shown), inlets 228, 236 are connected to an alternative source of plating solution. For example, inlets 228, 236 are connected to a pump which pumps plating solution to inlets 228, 236 through tubing. Further, although plating solution is provided to anode cup 202 from inlets 220, 228, 236, in other embodiments (not shown), only one or more of inlets 220, 228 and 236 are provided. For example, solution flow is directed into anode cup 202 through inlet 220 only and inlets 228, 236 (and corresponding outlets 224, 232, check valves and tubes 230, 234, respectively) are not provided. Alternatively, a plurality of inlets 220, 228, 236 can be provided.

Referring still to FIG. 2, the plating solution introduced into anode cup 202 then flows out of anode cup 202 via two routes. First, some of the plating solution flows through membrane 208 and into plating bath 42A. As discussed above, the porosity of membrane 208 allows plating solution to pass through yet prevents particulates over a certain size from passing through (hereinafter referred to as contaminant particulates). Thus, contaminant particulates generated as ion source material 206 dissolves do not pass through membrane 208 and into plating bath 42A and accordingly do not contaminate the wafer being electroplated. This is in contrast to conventional anode bags which allow unacceptably large (e.g. greater than 1.0 $\mu$m) particulates to pass through.

In addition to flowing through membrane 208, plating solution exits through outlets 240, 242 of anode cup 202. From outlets 240, 242, the plating solution flows through tubes 244, 246, though outlets 248, 250 of plating bath 42A and into overflow reservoir 56A. Check valves (not shown) can be provided to prevent backflow of plating solution from overflow reservoir 56A to anode cup 202. From overflow reservoir 56A, the plating solution is filtered to remove particulates including contaminant particulates and then returned to plating bath 42A and jet 200.

Of importance, plating solution removed from anode cup 202 through outlets 240, 242 does not directly enter plating bath 42A without first being filtered to remove contaminant particulates. Thus, outlets 240, 242 support a sufficient flow of plating solution through anode cup 202 to prevent anode passivation to the extent that membrane 208 does not.

Further, by locating outlets 240, 242 at the second end (top) of wall section 218 of anode cup 202, gas bubbles entrapped inside of anode cup 202, and more particularly, gas bubbles entrapped under membrane 208 are readily removed to overflow reservoir 56A.

Gas bubble removal is further enhanced by shaping membrane 208 as a frustum of an inverted right circular cone having a base at wall section 218 and an apex at jet 200. More particularly, by having the distance A between membrane 208 and base section 216 at wall section 218 greater than the distance B between membrane 208 and base section 216 at jet 200, gas bubbles entrapped under membrane 208 tend to move across membrane 208 from jet 200 to wall section 218. At wall section 218, these gas bubbles become entrained with the plating solution flowing through outlets 240, 242 and are removed into overflow reservoir 56A. Advantageously, these gas bubbles do not enter plating bath 42A and travel to the wafer and accordingly do not create nonuniformity in the deposited electrically conductive layer on the wafer.

Figure 3:
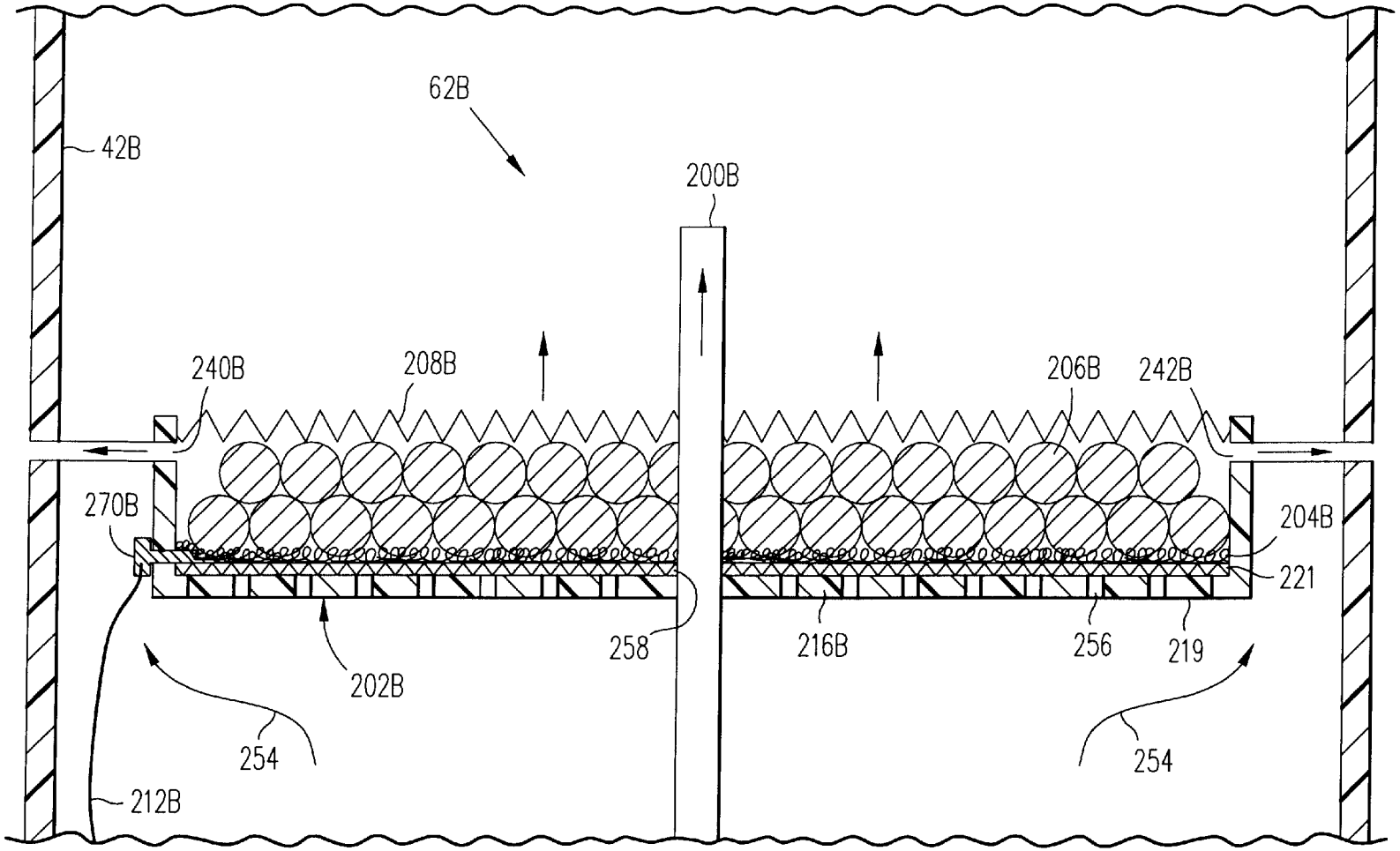
FIGS. 3 and 4 are cross-sectional views of anodes in accordance with alternative embodiments of the present invention.

FIG. 3 is a cross-sectional view of an anode 62B and jet 200B in accordance with an alternative embodiment of the present invention. In this embodiment, anode cup 202B has a perforated base section 216B comprising a plurality of apertures 256 extending from a lower surface 219 to an upper surface 221 of perforated base section 216B. Anode 62B further comprises a filter sheet 258 on upper surface 221 of perforated base section 216B. Contact 204B rests on filter sheet 258 and thereby on perforated base section 216B. Filter sheet 258 readily allows plating solution to flow through yet prevents contaminant particulates from passing through.

During use, plating solution is provided to jet 200B. Plating solution is also provided to plating bath 42B such that the plating solution flows upwards in plating bath 42B towards perforated base section 216B. As the plating solution encounters perforated base section 216B, a portion of the plating solution is diverted around anode cup 202B as indicated by arrows 254. Further, a portion of the plating solution flows through apertures 256, through filter sheet 258 and into anode cup 202B. The plating solution then flows across ion source material 206B preventing anode passivation.

The plating solution then exits anode cup 202B through membrane 208B and outlets 240B, 242B as described above in reference to anode 62A (FIG. 2). In contrast to anode 62A, anode 62B (FIG. 3) allows plating solution to directly enter anode cup 202B without the use of any additional tubing, checkvalves and associated inlets/outlets. In addition, there is greater flexibility in setting the flow rate of plating solution through jet 200B since plating solution is provided to anode cup 202B independent of jet 200B.

In anodes 62A, 62B of FIGS. 2,3, membranes 208, 208B enable jets 200, 200B, respectively, to pass through the center of the anode. Advantageously, this allows plating solution from jets 200, 200B to be directed at the center of the wafer being electroplated, enhancing removal of gas bubbles entrapped on the wafer plating surface and improving the uniformity of the deposited electrically conductive layer on the wafer. This is in contrast to conventional anode bags which do not allow the possibility of a configuration which passes a jet through the middle of the anode.

Figure 4:
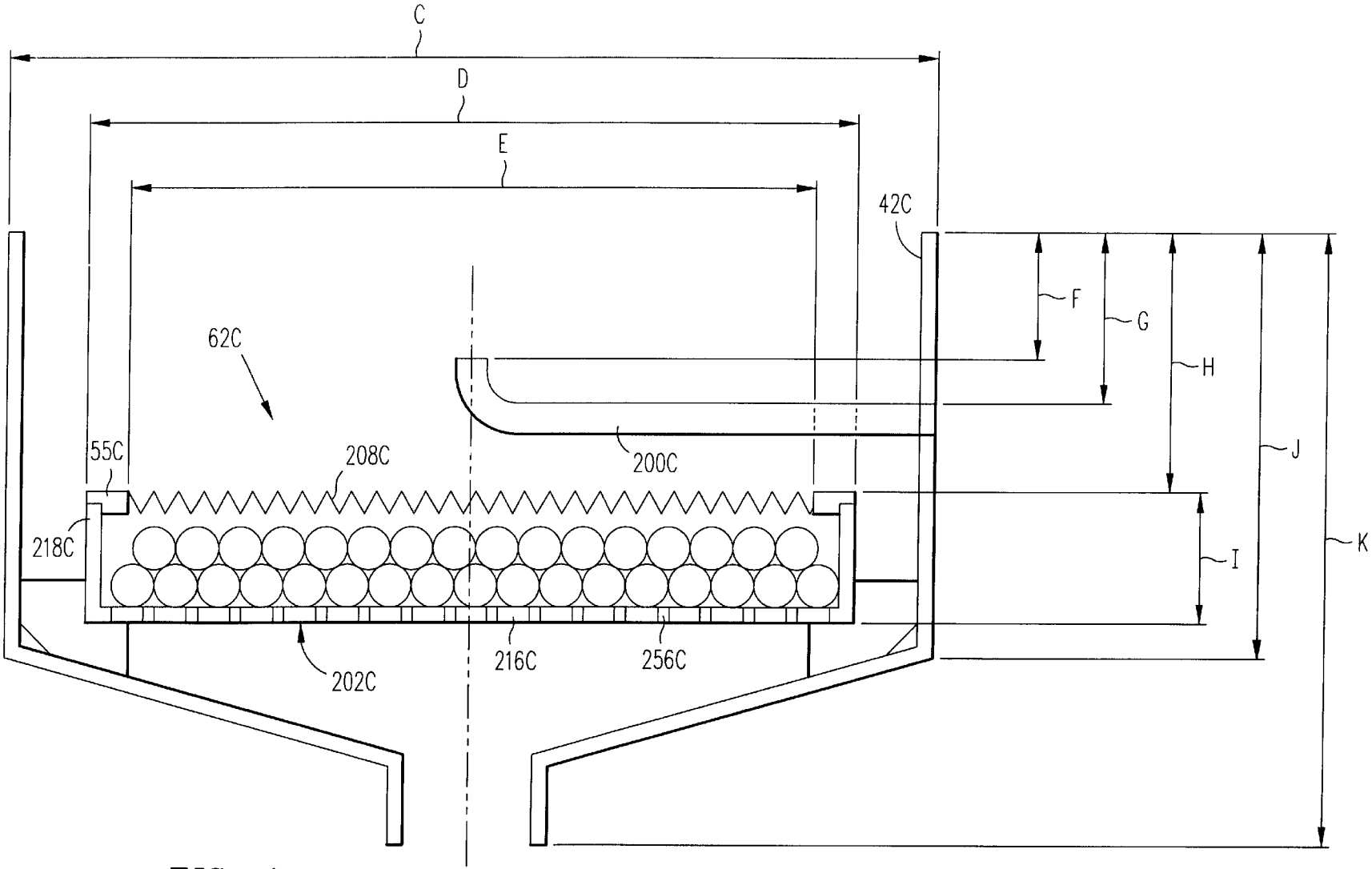

FIG. 4 is a cross-sectional view of an anode 62C and jet 200C in accordance with an alternative embodiment of the present invention. In this embodiment, jet 200C does not extend through the center of anode 62C but extends horizontally from plating bath 42C and curves upwards to direct plating solution at the center of the wafer (not shown) being electroplated. Accordingly, membrane 208C is a disk shaped integral membrane, i.e. does not have an aperture through which jet 200C passes. Anode cup 202C is provided with a perforated base section 216C having a plurality of apertures 256C. To prevent anode passivation, plating solution, enters anode cup 202C through apertures 256C of perforated base section 216C and then exits through membrane 208C.

At the second end (top) of wall section 218C of anode cup 202C, a shield 55C is located. Shield 55C is formed of an electrically insulating material and reduces the electric field and electric current flux at the edge region of the wafer plating surface. This reduces the thickness of the deposited electrically conductive layer on this edge region of the wafer plating surface thus compensating for the edge effect. (The edge effect is the tendency of the deposited electrically conductive layer to be thicker at the edge region of the wafer plating surface.) The edge effect is described in detail in Contolini et al., co-filed application Ser. No. 08/970,120 and the use of shields is describe in detail in Reid et al., co-filed application Ser. No. 08/969,267, both cited above. (Referring to FIG. 2, seal rings 312, 314 may also act as shields and reduce the electric field and electric current flux to the center region and edge region, respectively, of the wafer plating surface.)

Illustrative specifications for various characteristics of anode 62C, jet 200C and plating bath 42C shown in FIG. 4 are provided in Table I below.

TABLE I

| CHARACTERISTIC | DESCRIPTION | SPECIFICATION |
|---|---|---|
| C | Plating bath Diameter | 11.000 In. |
| D | Anode cup Diameter | 9.000 In. |
| E | Membrane outside Diameter | 8.000 In. |
| F | Jet opening depth | 1.500 In. |
| G | Jet entry depth | 2.000 In. |
| H | Anode cup depth | 3.000 In. |
| I | Anode cup thickness | 1.500 In. |
| J | Plating bath depth | 4.890 In. |
| K | Plating bath total height | 7.051 In. |

Having thus described the preferred embodiments, persons skilled in the art will recognize that changes may be made in form and detail without departing from the spirit and scope of the invention. For example, although the membrane is described as highly electrically resistive, the membrane can be highly electrically conductive. Further, the porosity of the membrane depends upon the maximum acceptance size particulates allowable into the plating bath. Thus, the porosity of membrane, depending upon the application, may allow particulates much greater or much less than 1.0 $\mu$m in size to pass through. Further, the membrane should allow ions to pass through but may or may not allow plating solution to flow through. Thus the invention is limited only by the following claims.

We claim:

1. An anode comprising:

an anode cup;

a membrane; and an ion source material, said anode cup and membrane forming an enclosure in which said ion source material is located.

2. The anode of claim 1 wherein said anode cup comprises a disk shaped base section having a first central aperture and said membrane has a second central aperture, wherein a jet passes through said first central aperture and said second central aperture.

3. The anode of claim 2 wherein said jet comprises an inlet, said inlet being located between said membrane and said base section of said anode cup.

4. The anode of claim 3 further comprising a checkvalve at said inlet.

5. The anode of claim 2 further comprising a first seal ring attached to said membrane at said second central aperture, said first seal ring forming a seal with said jet.

6. The anode of claim 1 wherein said membrane is disk shaped.

7. The anode of claim 1 wherein said membrane is shaped as a frustum of an inverted right circular cone having a base section at said anode cup.

8. The anode of claim 1 wherein said anode cup comprises a cylindrical wall section and a disk shaped base section, a first end of said wall section being attached to said base section, a second end of said wall section having one or more outlets.

9. The anode of claim 8 further comprising a second seal ring attached to an outer circumference of said membrane, said second seal ring forming a seal with said second end of said wall section.

10. The anode of claim 1 further comprising an electrical contact electrically connected with said ion source material.

11. The anode of claim 10 wherein said electrical contact is a mesh of electrically conductive material.

12. The anode of claim 11 wherein said electrical contact comprises titanium mesh.

13. The anode of claim 10 wherein said electrical contact comprises a plate with raised perforations.

14. The anode of claim 10 further comprising a rod passing through said anode cup, said rod being electrically connected to said electrical contact.

15. The anode of claim 1 wherein said ion source material comprises copper.

16. The anode of claim 1 wherein said ion source material comprises a plurality of granules.

17. The anode of claim 1 wherein said ion source material comprises a single integral piece.

18. The anode of claim 1 wherein said anode cup comprises an inlet on a base section of said anode cup.

19. The anode of claim 1 wherein said anode cup comprises an inlet on a wall section of said anode cup.

20. The anode of claim 1 wherein said anode cup comprises a base section having a plurality of perforations extending from a first surface to an second surface of said base section.

21. The anode of claim 20 further comprising a filter sheet on said second surface of said base section.

22. The anode of claim 21 further comprising an electrical contact on said filter sheet, said ion source material being electrically connected to said contact.

23. The anode of claim 1 wherein said anode cup comprises a polymer.

24. The anode of claim 23 wherein said polymer is selected from the group consisting of polypropylene and polyethylene.

25. The anode of claim 1 wherein said membrane has a porosity, said porosity being sufficient to prevent particulates larger than a predetermined size from passing through said membrane.

26. The anode of claim 25 wherein said porosity is sufficient to prevent particulates larger than 0.1 micron from passing through said membrane.

27. A method of preventing anode passivation comprising the steps of:

providing an anode comprising an anode cup, a membrane and ion source material, said ion source material being located in an enclosure formed by said anode cup and said membrane; and introducing plating solution into said enclosure and across said ion source material, wherein at least a first portion of said plating solution introduced into said enclosure exits said enclosure through said membrane.

28. The method of claim 27 wherein said membrane has a porosity, said porosity being sufficient to prevent particulates larger than a predetermined size from passing through said membrane.

29. The method of claim 27 wherein said anode cup comprises at least one plating solution outlet, wherein at least a second portion of said plating solution introduced into said enclosure exits said enclosure through said plating solution outlet.

30. The method of claim 29 further comprising the step of removing gas bubbles from said enclosure through said at least one plating solution outlet.

31. An electroplating system comprising:

a bath containing an electroplating solution;

a power supply;

a substrate immersed in said electroplating solution, a negative terminal of said power supply being electrically connected to said substrate; and an anode, a positive terminal of said power supply being electrically connected to said anode, said anode comprising:

an anode cup;

a membrane; and an ion source material, said anode cup and membrane forming an enclosure in which said ion source material is located.

32. The electroplating system of claim 31 wherein said anode comprises at least one inlet for allowing a flow of said electroplating solution into said anode.

33. The electroplating system of claim 32 wherein said anode comprises at least one outlet for allowing a flow of said electroplating solution out of said anode.

34. The electroplating system of claim 33 comprising a jet extending through said anode for directing a flow of said electroplating solution towards said substrate.

35. The electroplating system of claim 34 wherein at least one of said at least one inlets is in flow communication with said jet.

36. The electroplating system of claim 35 wherein at least one of said at least one outlets is in flow communication with an overflow reservoir.

37. The electroplating system of claim 36 comprising a flow path between said overflow reservoir and said jet.

38. The electroplating system of claim 34 wherein at least one of said at least one outlets is in flow communication with said jet.

* * * * *